US008353514B2

(12) United States Patent
Wu

(10) Patent No.: US 8,353,514 B2
(45) Date of Patent: Jan. 15, 2013

(54) SPHERICAL PUZZLE

(76) Inventor: Ming-Yuan Wu, Taipei (TW)

( * ) Notice: Subject to any disclaimer, the term of this patent is extended or adjusted under 35 U.S.C. 154(b) by 0 days.

(21) Appl. No.: 13/104,824

(22) Filed: May 10, 2011

(65) Prior Publication Data

US 2012/0001389 A1 Jan. 5, 2012

Related U.S. Application Data

(63) Continuation-in-part of application No. 12/827,543, filed on Jun. 30, 2010.

(51) Int. Cl.
*A63F 9/10* (2006.01)

(52) U.S. Cl. ..... 273/157 R

(58) Field of Classification Search ..... 273/153 R, 273/156, 157 R; 446/131
See application file for complete search history.

(56) References Cited

U.S. PATENT DOCUMENTS

| | | | | | |
|---|---|---|---|---|---|
| 1,523,188 | A | * | 1/1925 | Flood | 434/147 |
| 1,739,861 | A | * | 12/1929 | Roberts | 434/147 |
| 2,987,318 | A | * | 6/1961 | Hammer | 273/157 R |
| 3,618,955 | A | * | 11/1971 | Barnes | 273/157 R |
| 3,851,884 | A | * | 12/1974 | Myller | 273/157 R |
| 3,865,382 | A | * | 2/1975 | Myller | 273/157 R |
| 4,494,935 | A | * | 1/1985 | Miller | 434/132 |
| 5,080,591 | A | * | 1/1992 | Forsyth | 434/147 |
| 5,217,226 | A | * | 6/1993 | Christopher | 273/157 R |
| 5,441,261 | A | * | 8/1995 | Margolis et al. | 273/157 R |
| 5,676,550 | A | * | 10/1997 | Giamportone et al. | 434/132 |
| 5,882,199 | A | * | 3/1999 | Bernardino | 434/152 |
| 5,931,677 | A | * | 8/1999 | Rifat et al. | 434/131 |
| 6,068,486 | A | * | 5/2000 | Frank et al. | 434/135 |
| 6,398,221 | B1 | * | 6/2002 | Graham | 273/157 R |
| D490,482 | S | * | 5/2004 | Chuang | D21/479 |
| 6,729,880 | B1 | * | 5/2004 | Ruano | 434/131 |
| D497,398 | S | * | 10/2004 | Chuang | D21/479 |
| D511,798 | S | * | 11/2005 | Chuang | D21/479 |
| D518,114 | S | * | 3/2006 | Chuang | D21/479 |
| 2002/0135125 | A1 | * | 9/2002 | Wu | 273/156 |
| 2005/0029735 | A1 | * | 2/2005 | Liu et al. | 273/156 |
| 2005/0248090 | A1 | * | 11/2005 | Anders | 273/156 |
| 2006/0255538 | A1 | * | 11/2006 | Chen | 273/156 |
| 2008/0224396 | A1 | * | 9/2008 | Cocis et al. | 273/157 R |
| 2012/0001388 | A1 | * | 1/2012 | Wu et al. | 273/157 R |
| 2012/0001389 | A1 | * | 1/2012 | Wu | 273/157 R |

* cited by examiner

*Primary Examiner* — Raleigh W. Chiu
(74) *Attorney, Agent, or Firm* — Muncy, Geissler, Olds & Lowe, PLLC

(57) ABSTRACT

A spherical puzzle for learning knowledge about geography is disclosed. The spherical puzzle comprises a plastic sphere and a plurality of plastic puzzle pieces. The plastic puzzle pieces are arranged on the plastic sphere by a user and are held to the sphere by magnetism. The puzzle pieces are formed in the shape of specific land masses. Metal mesh is provided on either the plastic puzzle pieces or the plastic sphere to attract magnets on the puzzle pieces or the plastic sphere. A base is provided for holding the sphere and allows the sphere to be rotated or turned.

18 Claims, 25 Drawing Sheets

100
105
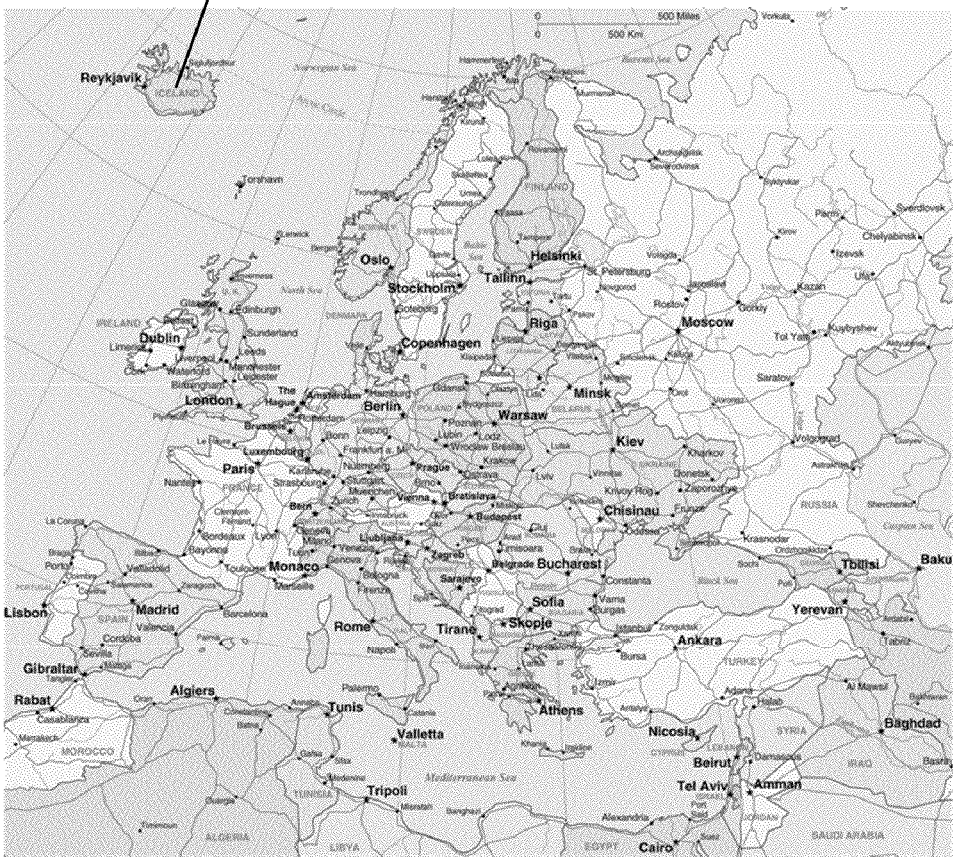
Figure 1A – Prior Art

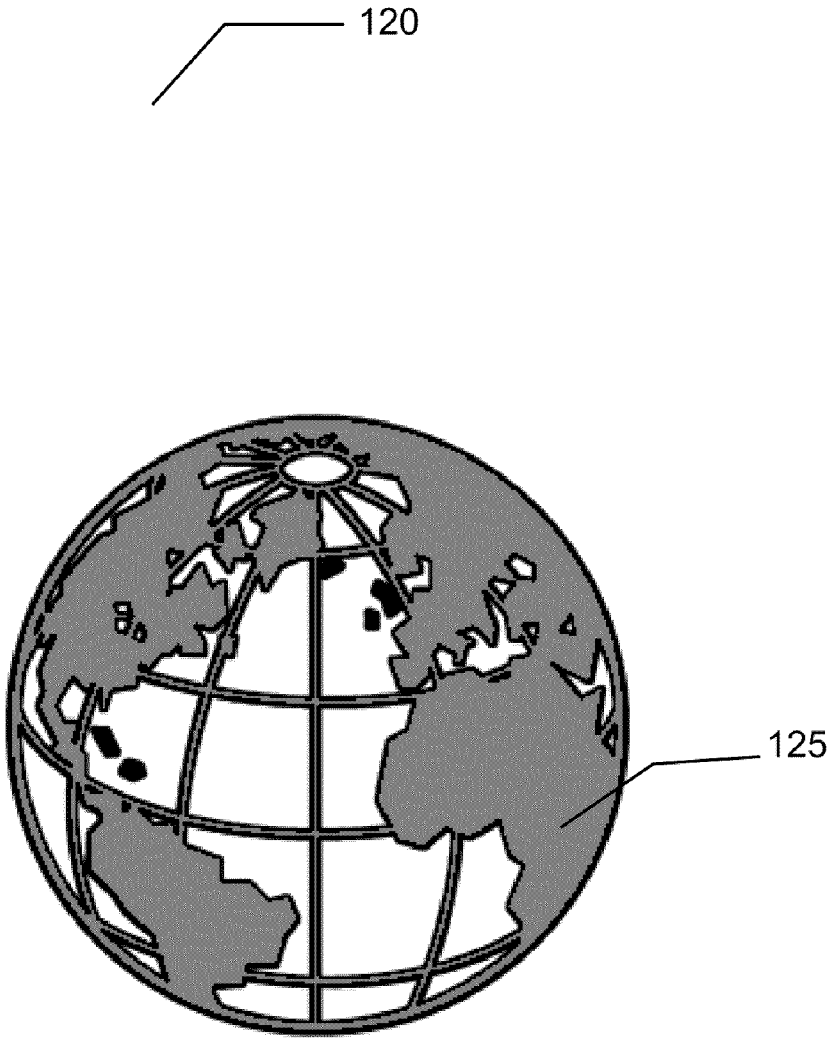
Figure 1B – Prior Art

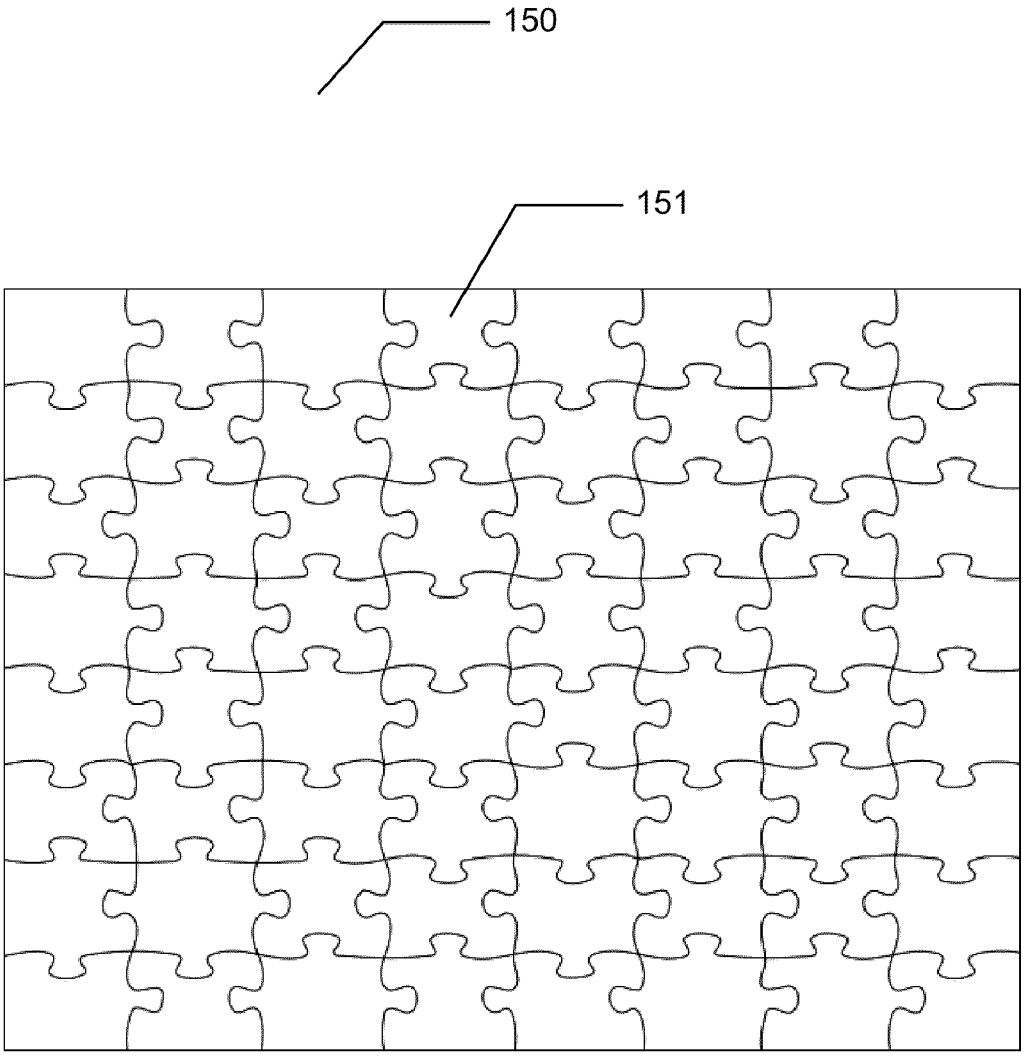
Figure 1C – Prior Art

SPHERICAL PUZZLE

The present invention is a continuous-in-part application of the application that is entitled "SPHERICAL PUZZLE" (application Ser. No. 12/827,543, filed Jun. 30, 2010), which is filed presently with the U.S. Patent & Trademark Office, and which is used herein for reference in its entirety.

BACKGROUND OF THE INVENTION

1. Field of the Invention

The present invention relates to educational puzzles. More specifically, the present invention discloses a spherical puzzle with shaped puzzle pieces that attach to a sphere to provide an effective geography education tool.

2. Description of the Prior Art

An understanding of geography is a basic fundamental of education. However, it can be difficult for students to grasp physical relationships or features of various countries of continents with the current educational tools.

Refer to FIG. 1A, which is a drawing illustrating a flat two-dimensional map of the prior art. The conventional flat two-dimensional map 100 is typically a printed piece of paper containing outlines of various countries 105.

When used as a learning tool, students must solely rely on memorization in order to learn the various countries 105 on the map 100. However, it is difficult for students to learn relationships between countries, country locations, and shapes of countries as the countries 105 printed on the map 100 are fixed.

A number of flat maps 100 can be bound in a book to form an atlas. However, the conventional atlas has the same disadvantages as a single flat map 100.

Refer to FIG. 1B, which is a drawing illustrating a conventional globe of the prior art. A globe 120 is another conventional tool to learn geography. Outlines of countries of the world 125 are printed on a paper which is then adhered to a round cardboard ball. While students can obtain a better sense of country location than with a map, the printed map of the globe 120 is fixed and the student has difficulty learning country shape.

Refer to FIG. 1C, which is a drawing illustrating a portion of a conventional jigsaw puzzle of the prior art. Jigsaw puzzles 150 are a common entertaining game where players fit puzzle pieces 151 together to form a single picture. While challenging and fun the shape of the individual puzzle pieces 151 bear no relationship with the content or image printed on the piece. Therefore, players tend to rely on trying to fit pieces in various locations until they find the proper position. This disadvantage makes conventional jigsaw puzzles 150 an inferior learning tool.

Therefore, there is need for an improved means of effectively providing and learning geographical information in an entertaining and informative manner.

SUMMARY OF THE INVENTION

To achieve these and other advantages and in order to overcome the disadvantages of the conventional methods in accordance with the purpose of the invention as embodied and broadly described herein, the present invention provides a spherical puzzle with shaped puzzle pieces that attach to a sphere to provide an effective geography education tool.

The spherical puzzle of the present invention comprises a sphere and a plurality of puzzle pieces. Each of the puzzle pieces is attachable to the sphere. For example, the sphere is made of plastic and each puzzle piece has a magnet. The plastic sphere further comprises a metal mesh layer or metal mesh pieces. Users place the magnetic puzzle piece over the metal mesh of the plastic sphere and magnetism holds the puzzle piece to the sphere.

Alternatively, the puzzle pieces are made of a plastic material with a metal mesh layer and the plastic sphere comprises a magnet or a plurality of magnets disposed on the interior or exterior of the sphere.

Also, in order to improve the effectiveness of learning, the puzzle pieces are formed in the shape of a land mass. For example, the puzzle piece is in the shape of a country, state, continent, province, region, etc. Some areas such as, for example, water, oceans, and seas are formed in the plastic sphere during production of the spherical puzzle.

Additionally, the puzzle pieces are contoured to show mountains, mountain ranges, and terrain contours. This allows students to learn additional information.

The spherical puzzle further comprises a resting base or a mounting base for holding the sphere. The mounting base allows the student to rotate the sphere. The resting base allows the student to rotate the sphere in any direction so that the student can easily position the puzzle pieces on any part of the sphere.

The puzzle pieces of the spherical puzzle further comprise data or information about the land mass or water mass such as country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information. This further increases the amount of information the student can learn when using the spherical puzzle.

When the data or information is provided on the outer side of the puzzle piece the student can easily reference the information. When the data or information is provided on the inner side of the puzzle the data is visible or is hidden and the student can challenge their memorization of the information.

The sphere further comprises markings or indicators such as longitudinal and latitudinal indicators, land mass location or outline, or water mass location or outline. These markings provide a visual prompting for the student and make the puzzle easier for beginning students.

To further expand learning the spherical puzzle further comprises a plurality of country flags that are attachable to the plurality of puzzle pieces. After a puzzle piece is attached to the sphere the student places the appropriate flag on the country.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings:

FIG. 1A is a drawing illustrating a flat two-dimensional map of the prior art;

FIG. 1B is a drawing illustrating a conventional globe of the prior art;

FIG. 1C is a drawing illustrating a portion of a conventional jigsaw puzzle of the prior art;

DESCRIPTION OF THE PREFERRED EMBODIMENTS

Figure 2:
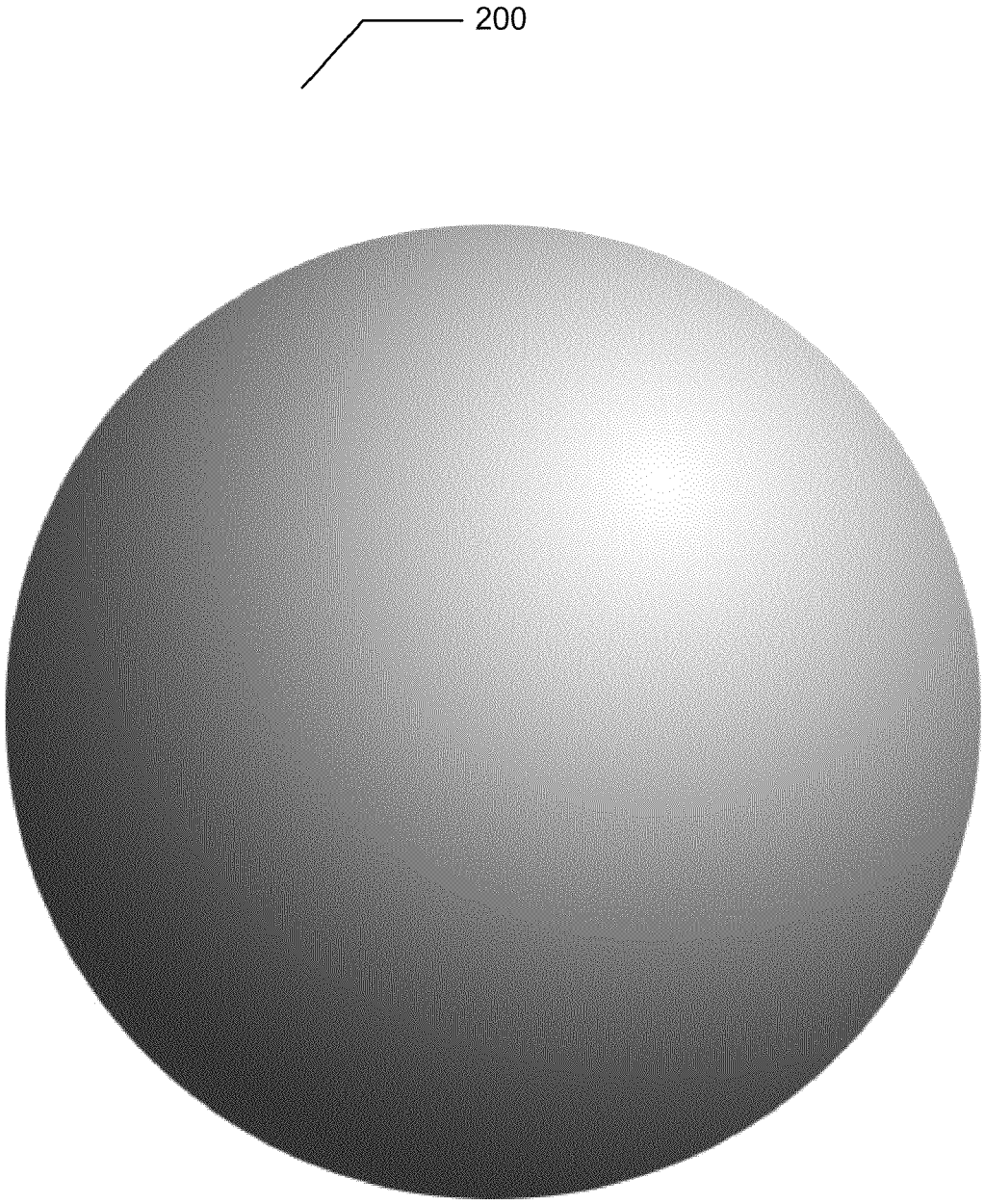
FIG. 2 is a drawing illustrating a sphere of a spherical puzzle according to an embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Refer to FIG. 2, which is a drawing illustrating a sphere of a spherical puzzle according to an embodiment of the present invention. As shown in FIG. 2, the sphere 200 is formed in the shape of an orb. For ease in manufacture the sphere 200 comprises, for example, two half-sphere pieces that attach together. In an embodiment of the present invention the two half-sphere pieces are attached together prior to delivery to the user or distributor. In another embodiment the two half-sphere pieces are attached together by the user. For example, one half-sphere comprises a rim flange to allow the two pieces to fit tightly together to form the sphere 200.

In an embodiment of the present invention the sphere 200 comprises a metal material. In this embodiment the puzzle pieces comprise magnetic material to allow the puzzle pieces to hold to the metallic sphere 200 via magnetism. In another embodiment of the present invention the sphere 200 comprises a non-metallic material, for example plastic. In this embodiment the sphere 200 further comprises magnetic material on the interior or exterior of the sphere 200 and the puzzle pieces are metallic.

In an embodiment of the present invention the two half-sphere pieces fit together and the attaching point forms a line representing the equator. This allows the user to additionally learn information regarding the two hemispheres of the earth.

Figure 3A:
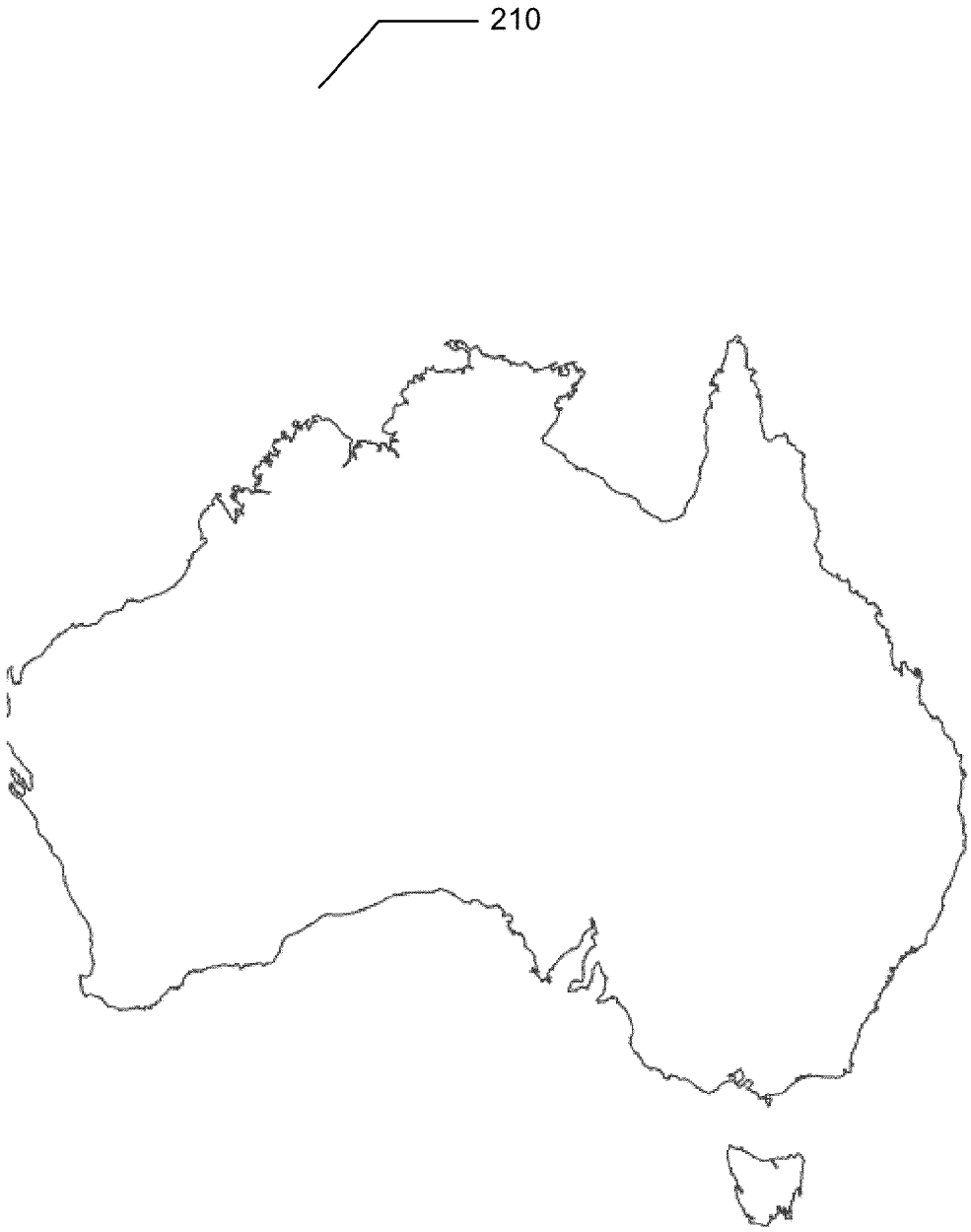
FIG. 3A is a drawing illustrating a top view of a puzzle piece of a spherical puzzle according to an embodiment of the present invention.

Refer to FIG. 3A, which is a drawing illustrating a top view of a puzzle piece of a spherical puzzle according to an embodiment of the present invention. In the embodiment of the present invention illustrated in FIG. 3A, the puzzle piece 210 is formed in the shape of a land mass such as, for example, a country, a continent, a state, a province, a region, a territory or a water mass such as, for example, a lake, an ocean, or a sea.

Since the shape of the puzzle pieces 210 relate to the shape of the land mass or water mass, the user learns the geographical shape as well as the position/location of the land or water mass. This is an advantage of the present invention.

Additionally, in embodiments of the present invention where the puzzle pieces 210 are in the shape of continents the user can obtain a better grasp of continental drift theory by positioning the puzzle pieces closer together or in their current position.

In some embodiments of the present invention the puzzle pieces 210 of the spherical puzzle further comprise data or information about the land mass or water mass such as country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information. This further increases the amount of information the student can learn when using the spherical puzzle.

Figure 3B:
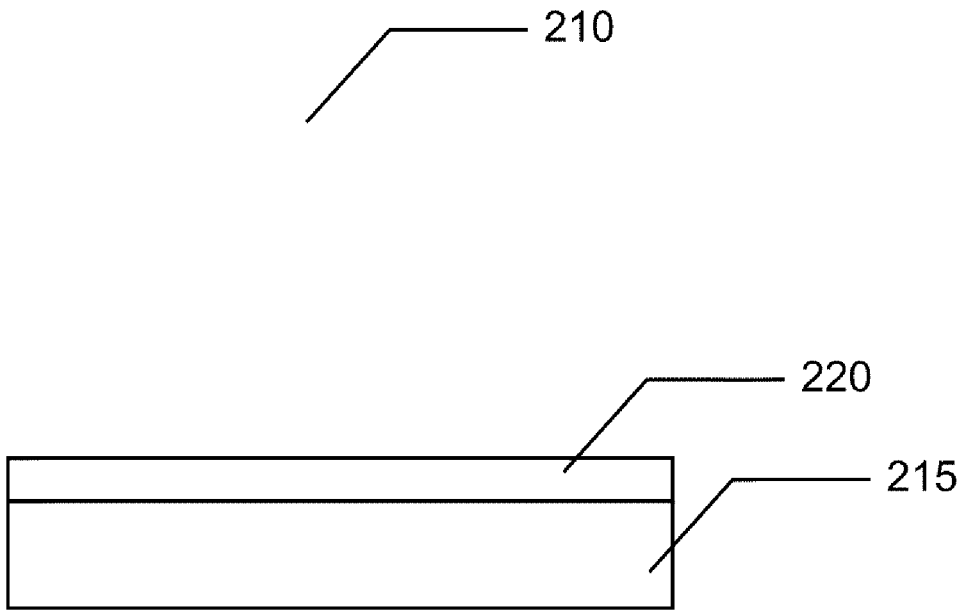
FIG. 3B is a drawing illustrating a side view of a puzzle piece of a spherical puzzle according to an embodiment of the present invention.
Figure 3C:
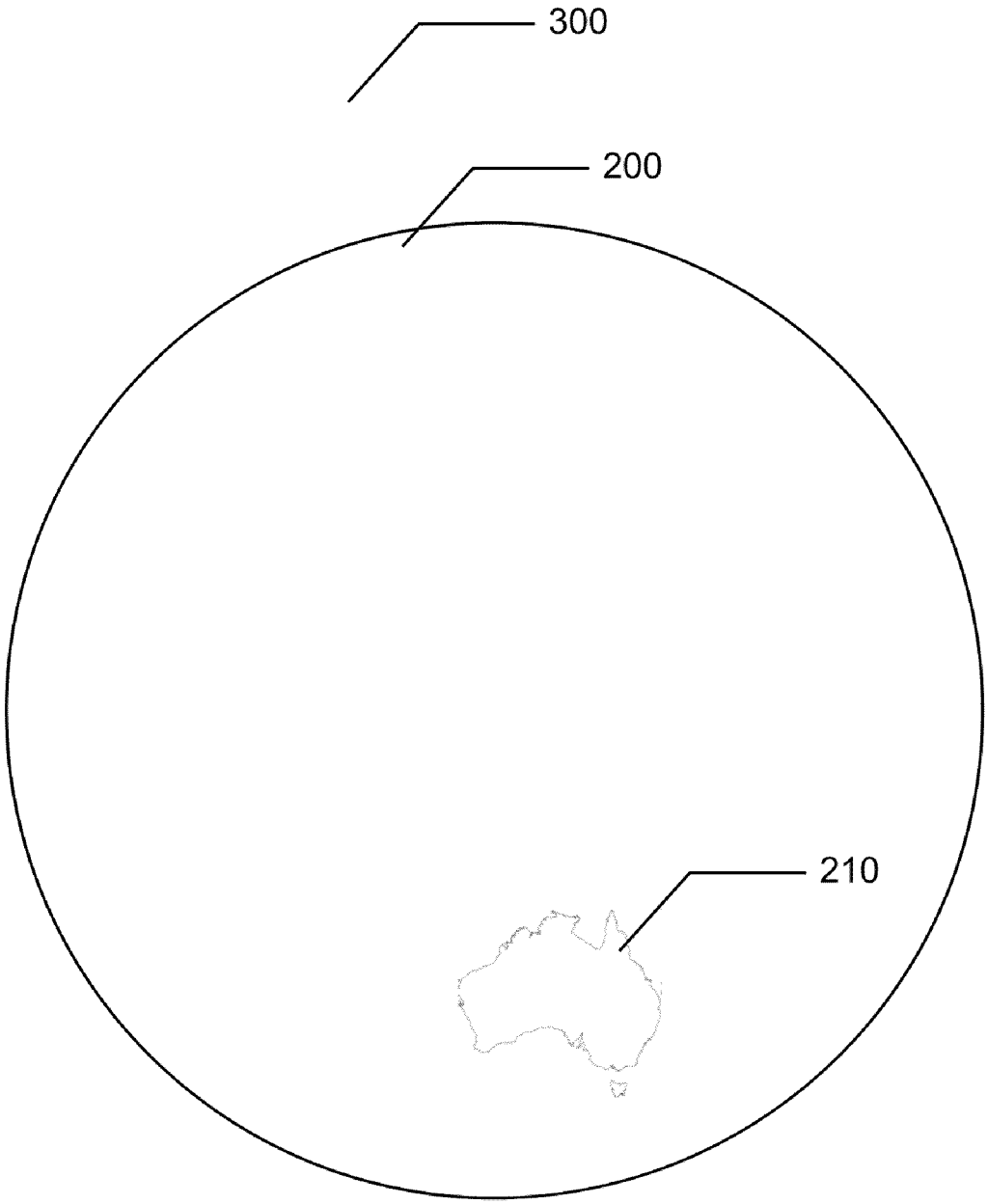
FIG. 3C is a drawing illustrating a spherical puzzle with a puzzle piece attached to a sphere according to an embodiment of the present invention.

Refer to FIG. 3B, which is a drawing illustrating a side view of a puzzle piece of a spherical puzzle according to an embodiment of the present invention and to FIG. 3C, which is a drawing illustrating a spherical puzzle with a puzzle piece attached to a sphere according to an embodiment of the present invention.

In an embodiment of the present invention the puzzle piece 210 comprises a magnetic layer 215 and a printed layer 220. The printed layer 220 is, for example, printed directly on the magnetic layer 215 or printed on a separate layer and adhered to the magnetic layer 215.

The puzzle piece 210 is thin or flexible enough so that the puzzle piece 210 will automatically conform to the arc of the sphere 200.

Figure 4:
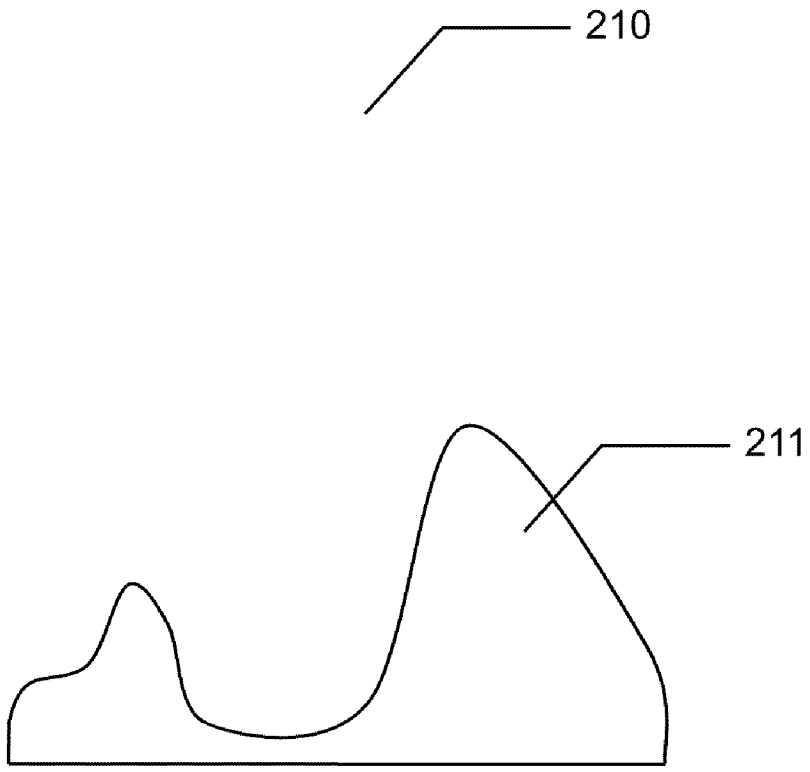
FIG. 4 is a drawing illustrating a side view of a puzzle piece with terrain contours of a spherical puzzle according to an embodiment of the present invention.

Refer to FIG. 4, which is a drawing illustrating a side view of a puzzle piece with terrain contours of a spherical puzzle according to an embodiment of the present invention.

In an embodiment of the present invention the puzzle piece 210 further comprises contours 211 to represent terrains, mountains, mountain ranges, or elevations. This allows the user to further learn information about terrains and elevations. The user can easily see and understand mountain formations of various countries. This is another advantage of the present invention.

In an embodiment of the present invention the contours 211 are integrated into the puzzle piece 210. In another embodiment of the present invention the contours 211 are formed in a piece separate from the basic puzzle piece and the contoured piece attaches to the basic puzzle piece. This provides an increased difficulty level for the student as they need to understand country location as well as terrain location.

Figure 5:
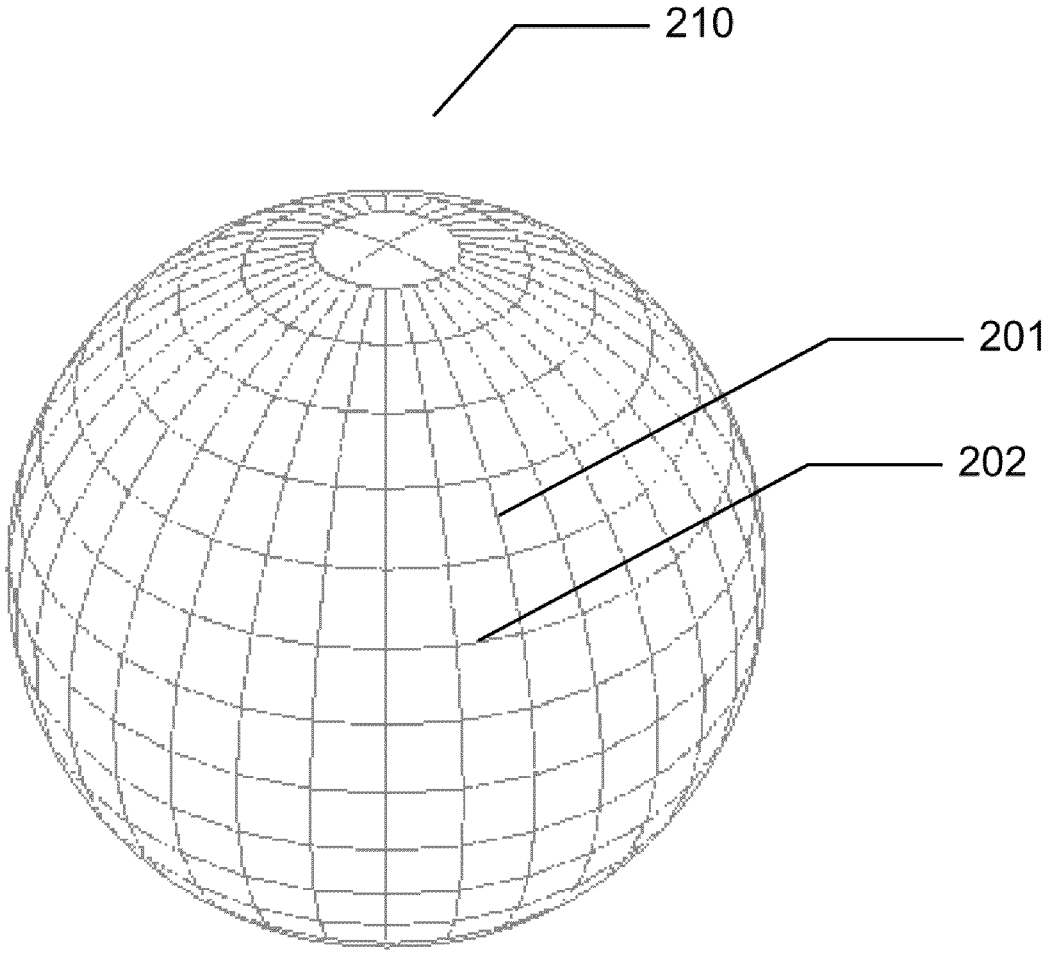
FIG. 5 is a drawing illustrating a sphere with longitudinal and latitudinal indicators.

Refer to FIG. 5, which is a drawing illustrating a sphere with longitudinal and latitudinal indicators.

In the embodiment of the present invention illustrated in FIG. 5, the sphere 200 further comprises markings that indicate longitude 201 and latitude 202. In this embodiment the longitudinal 201 and latitudinal 202 indicators provide a reference for the user. Additionally, in embodiments where longitudinal and latitudinal information is provided on the puzzle piece, the user can more easily locate the proper position for the puzzle piece.

In another embodiment of the present invention the sphere 200 further comprises markings that indicate land mass or water mass. For example, outlines of countries or continents are provided so users can easily match the shape of the puzzle piece to the markings to find the correct position and orientation for the puzzle piece.

Figure 6:
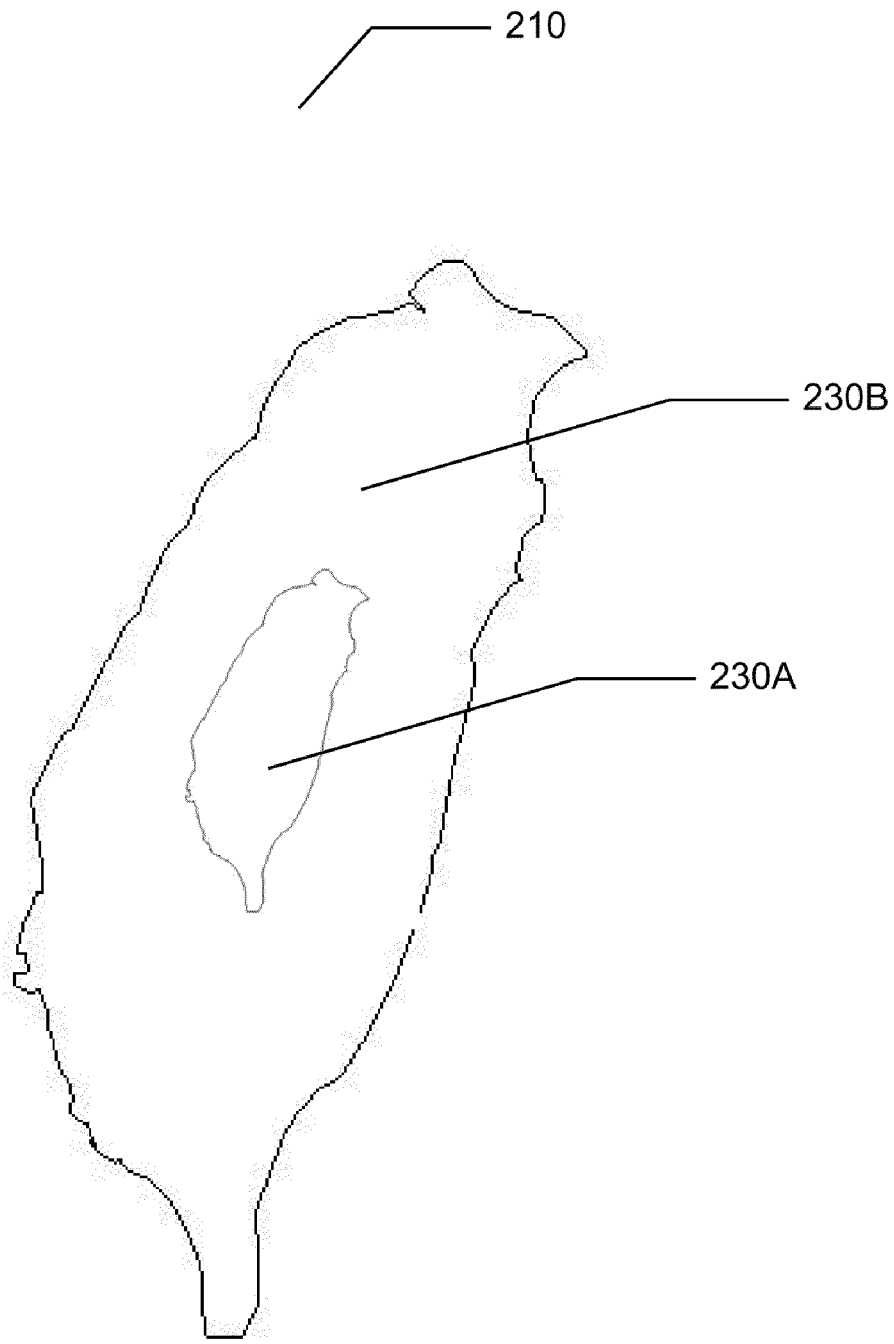
FIG. 6 is a drawing illustrating an ocean puzzle piece formed in the shape of a small country according to an embodiment of the present invention.

Refer to FIG. 6, which is a drawing illustrating an ocean puzzle piece formed in the shape of a small country according to an embodiment of the present invention.

Since some land masses 230A such as islands are quite small it is not feasible to form the puzzle piece 210 in a separate piece. Therefore, in an embodiment of the present invention the land mass 230A is combined with a water mass or a portion of a water mass 230B to form the puzzle piece 210. For example, an island or a plurality of islands is/are combined with an ocean puzzle piece.

In the embodiment illustrated in FIG. 6 the small land mass 230A is included with a portion of a water mass 230B. However, the land mass shape is retained by forming the portion of the water mass in the shape of the small land mass.

In an embodiment of the present invention a plurality of small land masses are formed in one puzzle piece.

In an embodiment of the present invention a small land mass is combined with a larger land mass in one puzzle piece.

Figure 7A:
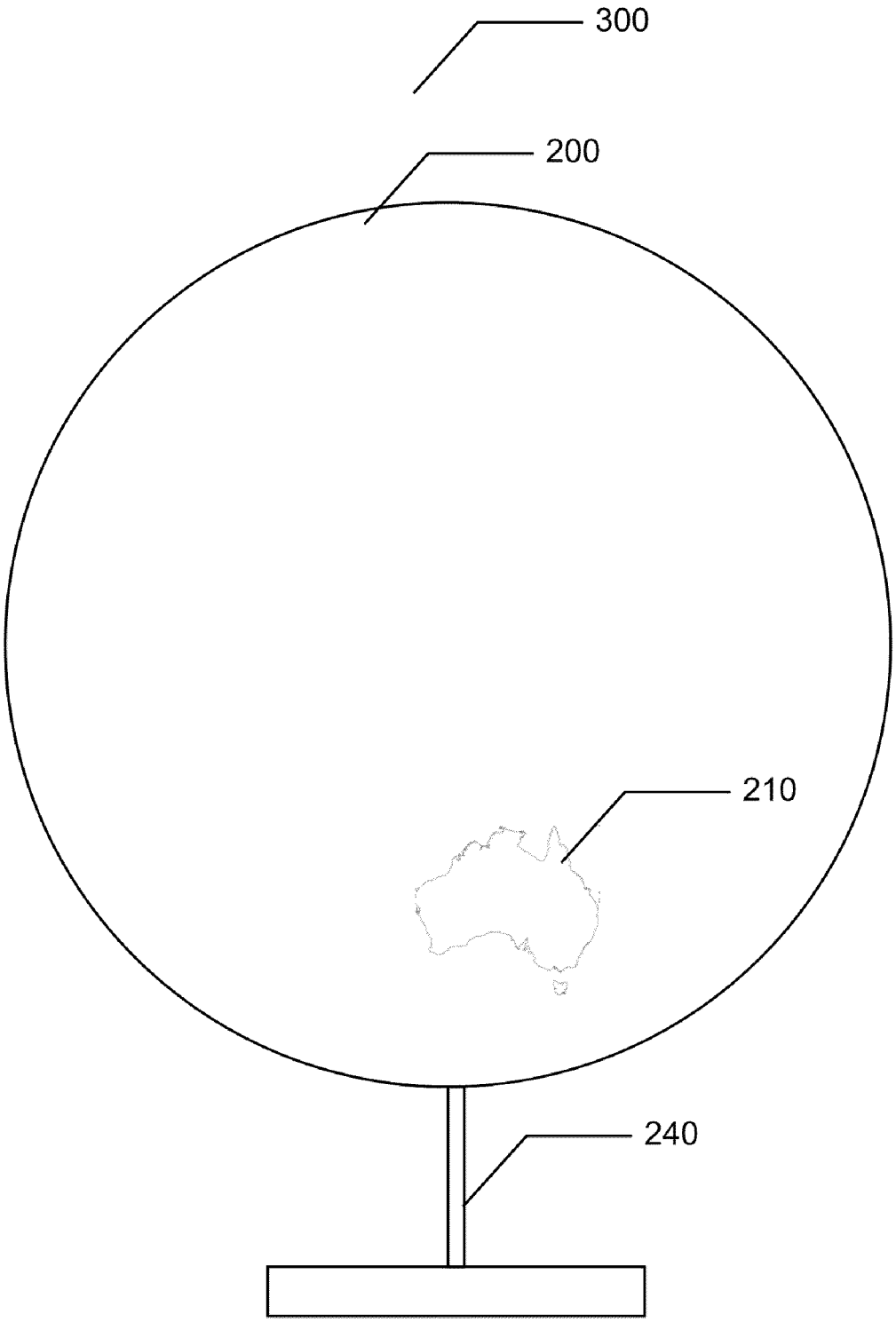
FIG. 7A is a drawing illustrating a sphere with sphere mounting base according to an embodiment of the present invention.

Refer to FIG. 7A, which is a drawing illustrating a sphere with sphere mounting base according to an embodiment of the present invention.

In the embodiment of the present invention illustrated in FIG. 7A the spherical puzzle 300 further comprises a mounting base 240. The mounting base 240 allows the sphere 200 to be positioned for display or use and allows the user to easily rotate or spin the sphere 200.

Figure 7B:
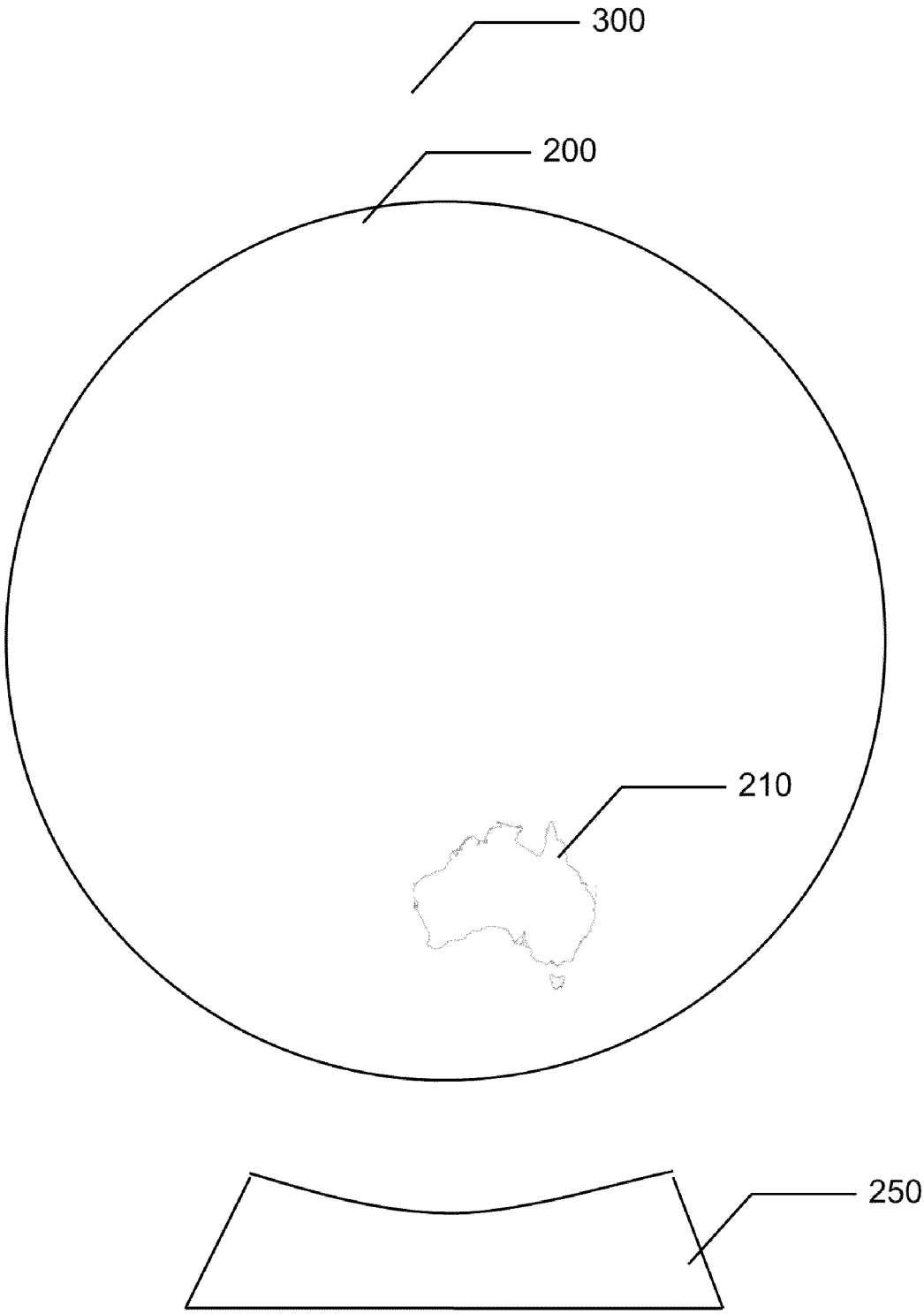
FIG. 7B is an exploded view drawing illustrating a sphere and a sphere resting base according to an embodiment of the present invention.
Figure 7C:
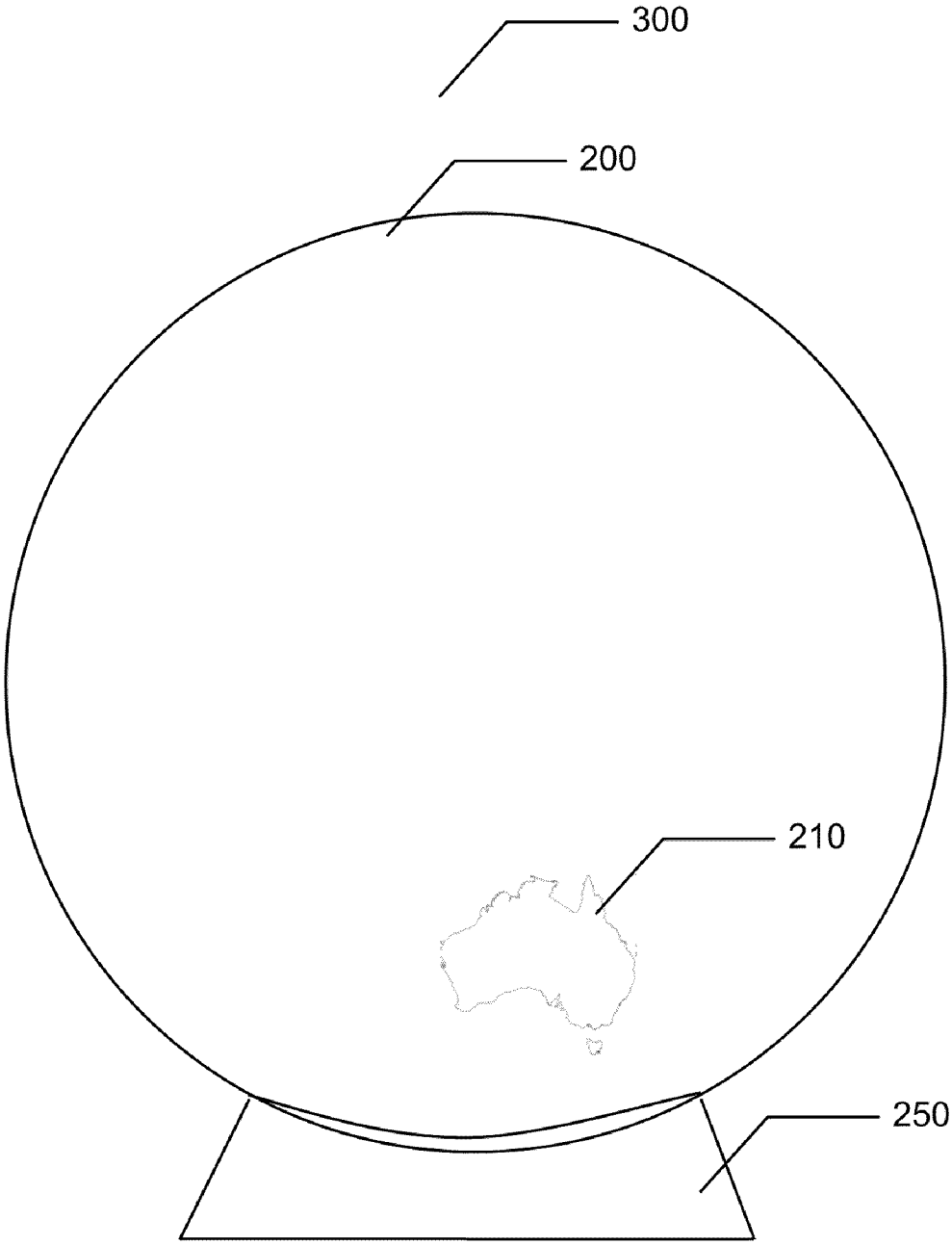
FIG. 7C is an assembled view drawing illustrating a sphere and a sphere resting base according to an embodiment of the present invention.

Refer to FIG. 7B, which is an exploded view drawing illustrating a sphere and a sphere resting base according to an embodiment of the present invention and to FIG. 7C, which is an assembled view drawing illustrating a sphere and a sphere resting base according to an embodiment of the present invention.

In the embodiment of the present invention illustrated in FIGS. 7B and 7C the spherical puzzle 300 further comprises a sphere resting base 250. The top of the sphere resting base 250 is formed to allow the sphere 200 to sit and rest in the resting base 250. In this embodiment the user can easily reposition the sphere 200 in order to inspect various portions of the sphere 200. For example, Australia is located in the lower region of the sphere and it would be difficult for a user to position the Australia puzzle piece 210. With the sphere 200 resting in the sphere resting base 250 the user can easily rotate the sphere 200 so that Australia's location is position at or closer to the top. This freedom of movement of the sphere 200 enhances the user experience.

Figure 8A:
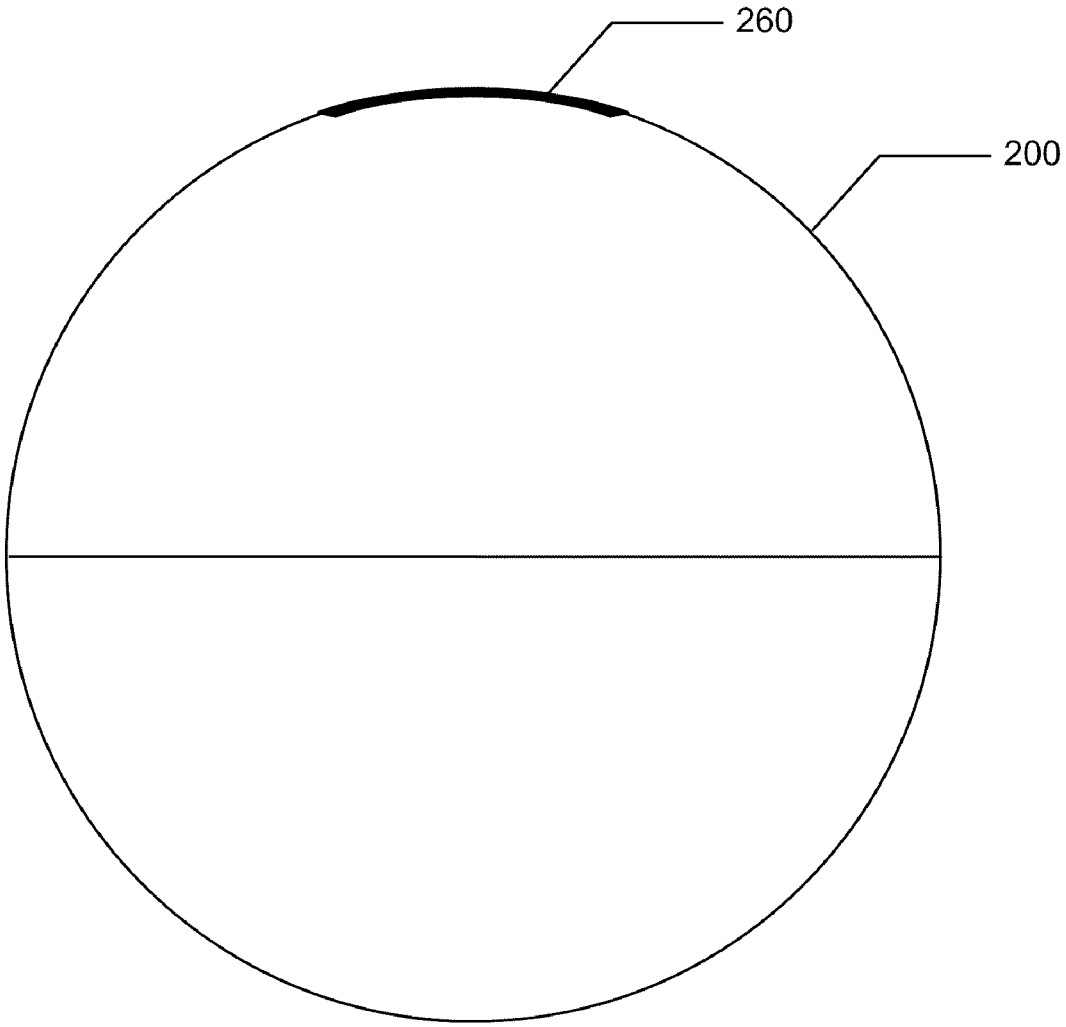
FIG. 8A is a cross-sectional drawing illustrating a spherical puzzle with interior metal mesh according to an embodiment of the present invention.
Figure 8B:
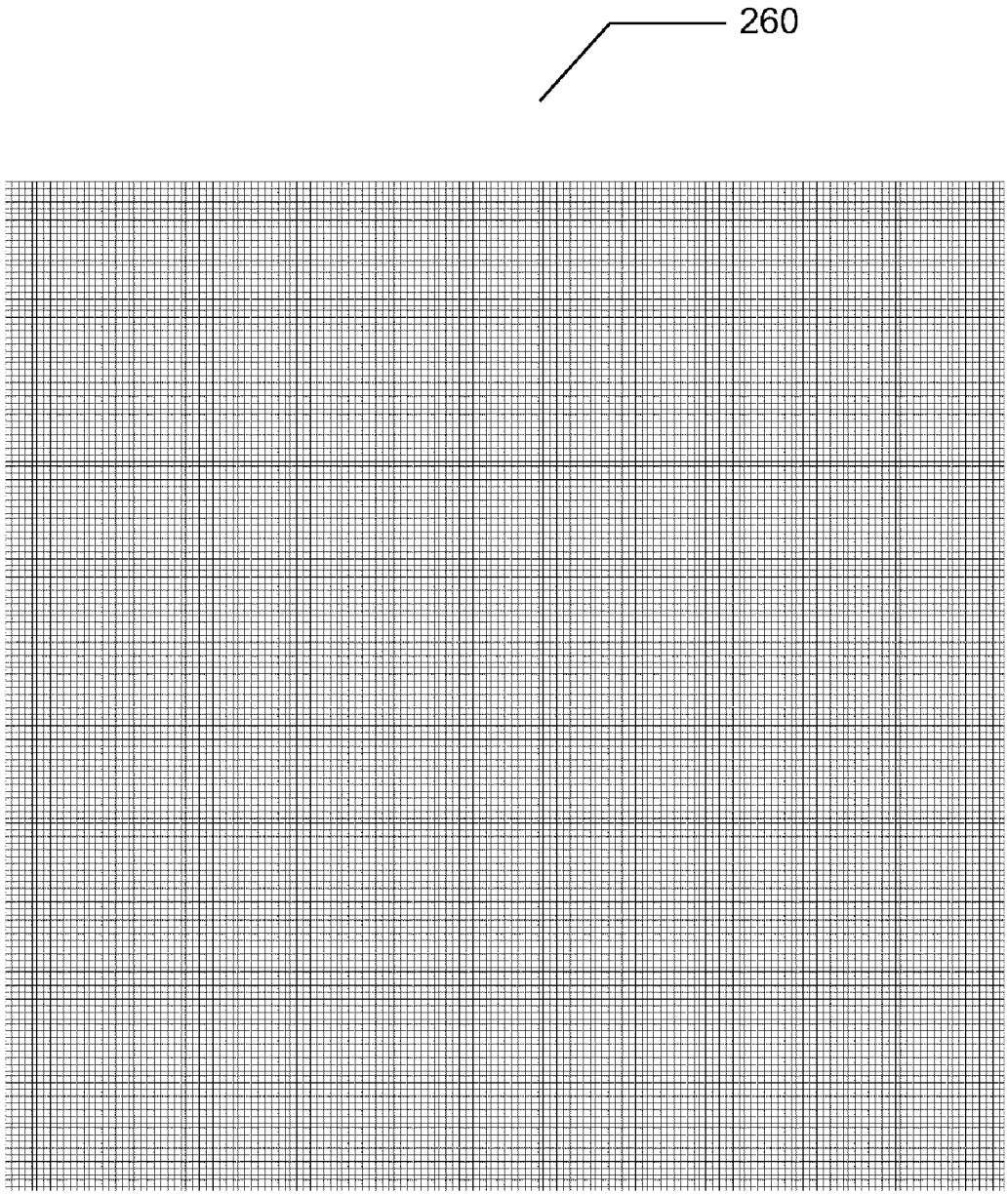
FIG. 8B is a drawing illustrating metal mesh according to an embodiment of the present invention.

Refer to FIG. 8A, which is a cross-sectional drawing illustrating a spherical puzzle with interior metal mesh according to an embodiment of the present invention and to FIG. 8B, which is a drawing illustrating metal mesh according to an embodiment of the present invention.

In the embodiment of the present invention illustrated in FIG. 8A the spherical puzzle comprises a plastic sphere 200. A metal mesh 260 is positioned inside or on the interior surface of the plastic sphere 200.

The metal mesh 260 is a flexible or semi-flexible metal material that flexes to conform to the shape or contour of the plastic sphere 200 or the puzzle pieces. The metal mesh 260 is attached to the plastic sphere 200 or the puzzles pieces by, for example, an adhesive.

In an embodiment of the present invention the metal mesh 260 is provided in only the positions where the puzzle pieces attach to the plastic sphere.

The combination of the metal mesh 260 and a magnet allow the puzzle piece to be attached magnetically to the plastic sphere 200.

In an embodiment of the present invention the plastic sphere 200 comprises two half-sphere pieces that fit together to form the plastic sphere 200.

Figure 8C:
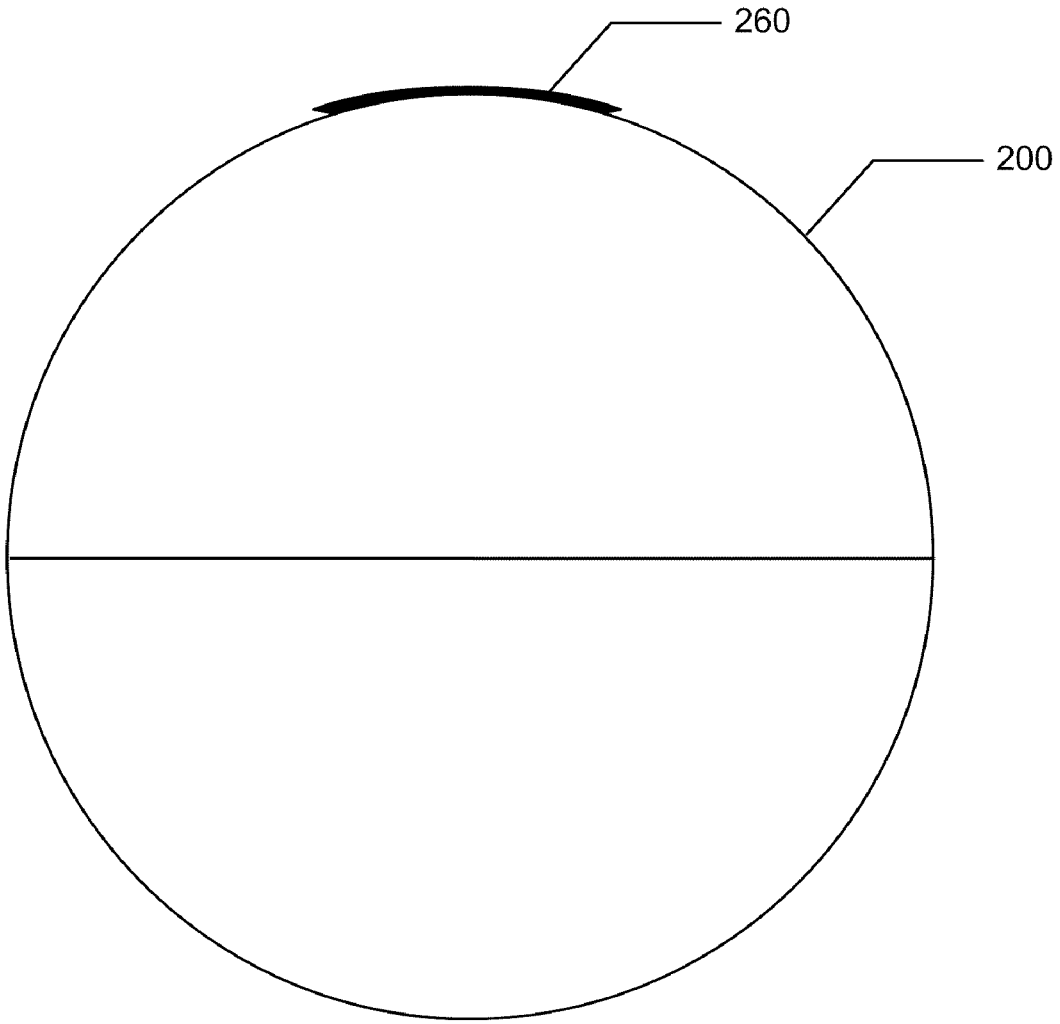
FIG. 8C is a cross-sectional drawing illustrating a spherical puzzle with exterior metal mesh according to an embodiment of the present invention.

Refer to FIG. 8C, which is a cross-sectional drawing illustrating a spherical puzzle with exterior metal mesh according to an embodiment of the present invention.

In the embodiment illustrated in FIG. 8C the metal mesh 260 is similar to the metal mesh 260 for FIG. 8A but in this embodiment the metal mesh 260 is positioned on the outside or exterior surface of the plastic sphere 200.

In certain production situations it is easier to position the metal mesh 260 on the outside or exterior surface of the plastic sphere 200. For example, in embodiments where the plastic sphere 200 is a single molded sphere, applying the metal mesh 260 to the outside surface of the plastic sphere 200 is more practical.

The spherical puzzle of the present invention further comprises puzzle pieces formed in the shape of a land mass such as, for example, a country, a continent, a state, a province, a region, or a territory.

Since the shape of the puzzle pieces relate to the shape of the land mass the user learns the geographical shape as well as the position/location of the land mass. This is an advantage of the present invention.

In some embodiments of the present invention the puzzle pieces of the spherical puzzle further comprise data or information about the land mass such as country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information. This further increases the amount of information the student can learn when using the spherical puzzle.

Figure 9A:
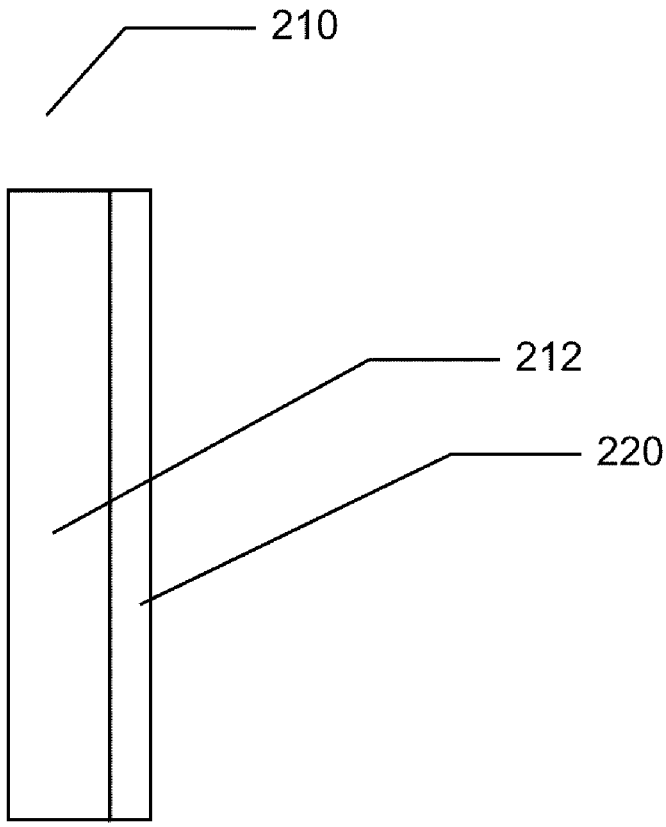
FIG. 9A is a drawing illustrating a plastic puzzle piece with printing on the front of the plastic puzzle piece according to an embodiment of the present invention.

Refer to FIG. 9A, which is a drawing illustrating a plastic puzzle piece with printing on the front of the plastic puzzle piece according to an embodiment of the present invention.

In the embodiment illustrated in FIG. 9A, the plastic puzzle piece 210 comprises a plastic layer 212 that provides a base for the plastic puzzle piece 210. The plastic layer 212 is formed in the shape of a specific land mass. For example, the plastic layer 212 is formed in the shape of California, Europe, Thailand, etc.

The plastic puzzle piece 210 further comprises a printed layer 220. In this embodiment the printed layer 220 is disposed on the front surface of the plastic layer 212. The printed layer 220 of the plastic puzzle piece 210 is clearly visible on the front surface of the plastic layer 212 and provides additional information or features for the plastic puzzle piece 210. The printed layer 220 comprises, for example, colors, outlines, geographical markers, place names, etc.

Figure 9B:
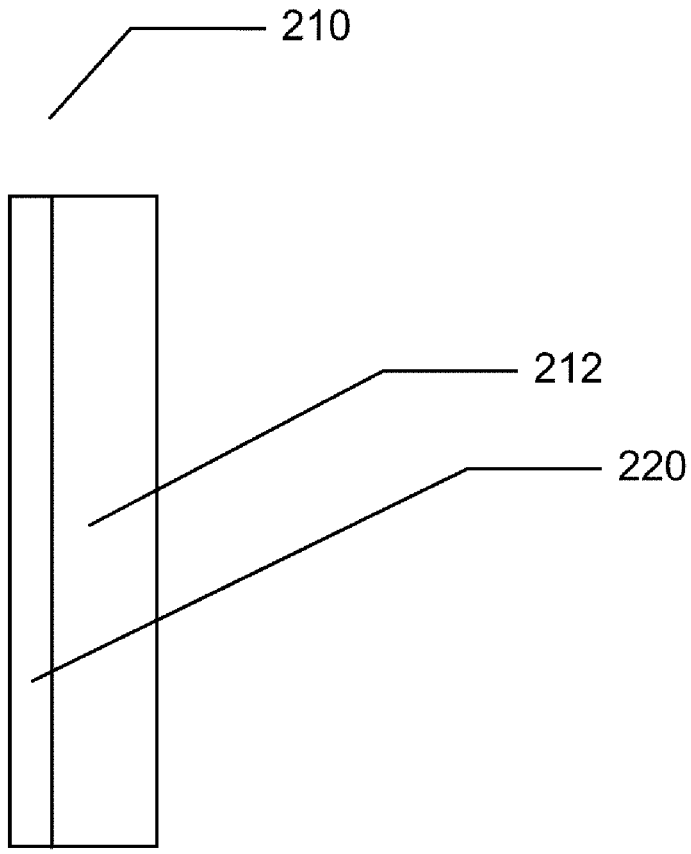
FIG. 9B is a drawing illustrating a plastic puzzle piece with printing on the back of the plastic puzzle piece according to an embodiment of the present invention.

Refer to FIG. 9B, which is a drawing illustrating a plastic puzzle piece with printing on the back of the plastic puzzle piece according to an embodiment of the present invention.

In the embodiment illustrated in FIG. 9B the printed layer 220 is disposed on the back surface of the plastic layer 212. In this embodiment of the present invention the plastic layer 212 comprises a transparent plastic material. Since the plastic layer 212 is transparent, the details of the printed layer 220 are visible from the front side of the plastic layer 212. Positioning the printed layer 220 behind the plastic layer 212 provides protection from scratches or damages for the printed layer 220 as the printed layer 220 is not exposed.

Figure 10A:
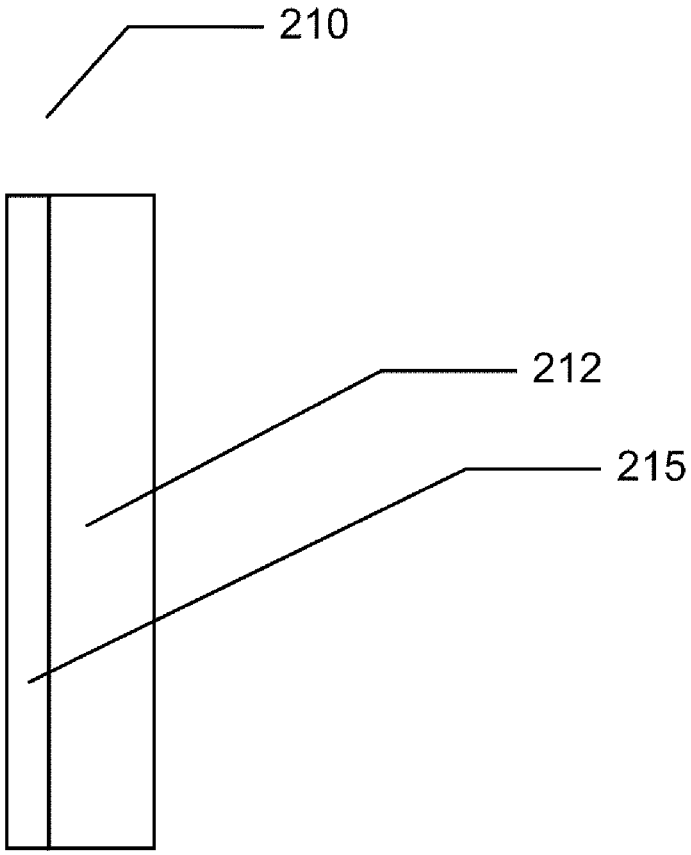
FIG. 10A is a drawing illustrating a plastic puzzle piece with magnet according to an embodiment of the present invention.

Refer to FIG. 10A, which is a drawing illustrating a plastic puzzle piece with magnet according to an embodiment of the present invention.

In the embodiment illustrated in FIG. 10A the plastic puzzle piece 210 comprises a plastic layer 212 and a magnetic layer 215 disposed on the back surface of the plastic layer 212. The magnetic layer 215 along with the metal mesh of the plastic sphere allows the plastic puzzle piece 210 to magnetically attach to the plastic sphere.

Figure 10B:
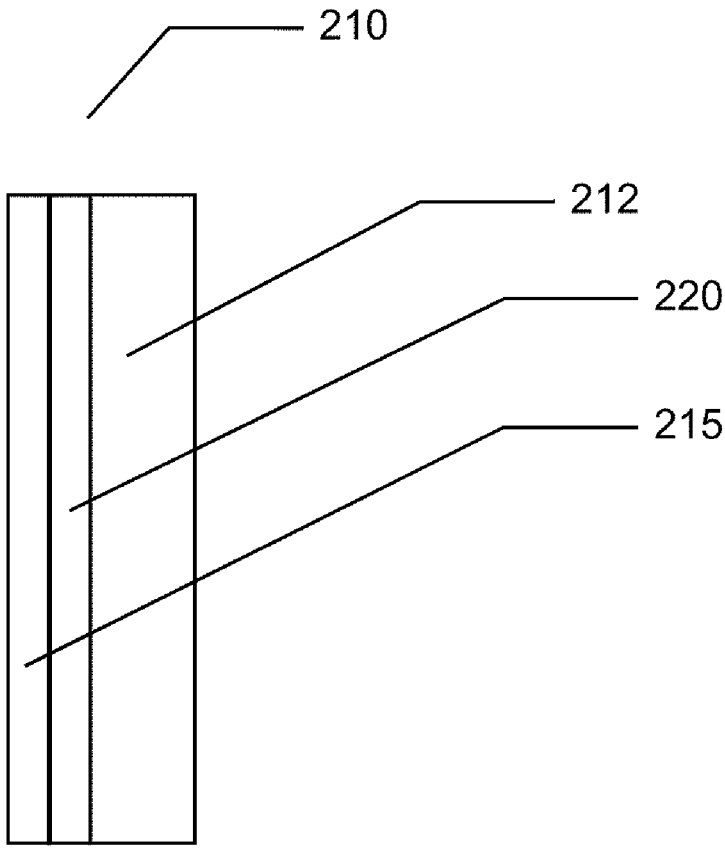
FIGS. 10B-10C are drawings illustrating a plastic puzzle piece with printing and magnet according to embodiments of the present invention.

Refer to FIG. 10B which is a drawing illustrating a plastic puzzle piece with printing and magnet according to an embodiment of the present invention.

In the embodiment illustrated in FIG. 10B the plastic puzzle piece 210 comprises a transparent plastic layer 212, a magnetic layer 215, and a printed layer 220. The printed layer 220 is disposed on the back surface of the plastic layer 212.

The magnetic layer 215 is disposed on the printed layer 220 with the printed layer 220 between the magnetic layer 215 and the plastic layer 212. Since the plastic layer 212 is transparent the details of the printed layer 220 are visible from the front of the plastic layer 212.

Figure 10C:
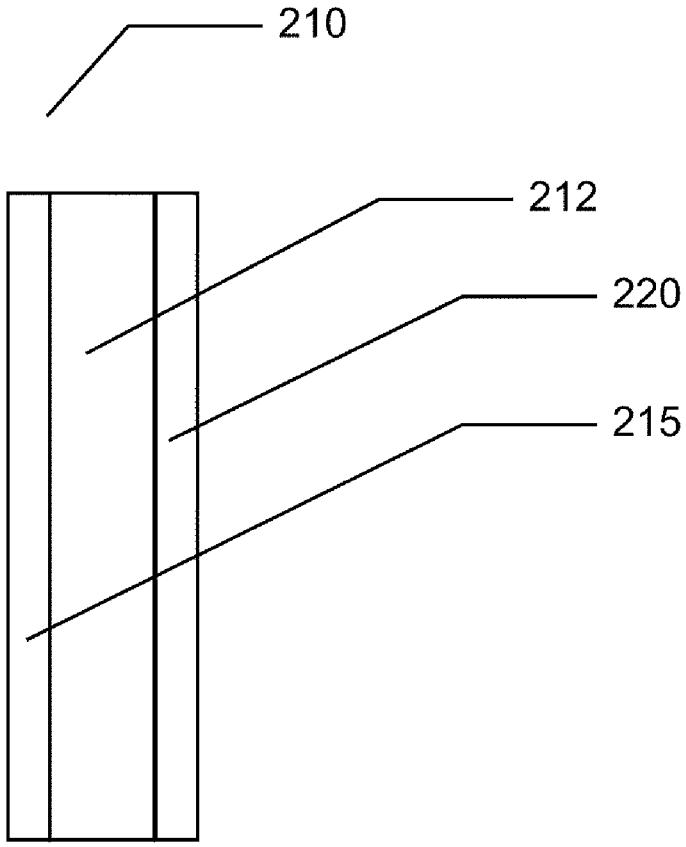

Refer to FIG. 10C which is a drawing illustrating a plastic puzzle piece with printing and magnet according to an embodiment of the present invention.

In the embodiment illustrated in FIG. 10C the plastic puzzle piece 210 comprises a magnetic layer 215, a plastic layer 212, and a printed layer 220.

The magnetic layer 215 is disposed on the back surface of the plastic layer 212. The printed layer 220 is disposed on the front surface of the plastic layer 212.

Figure 10D:
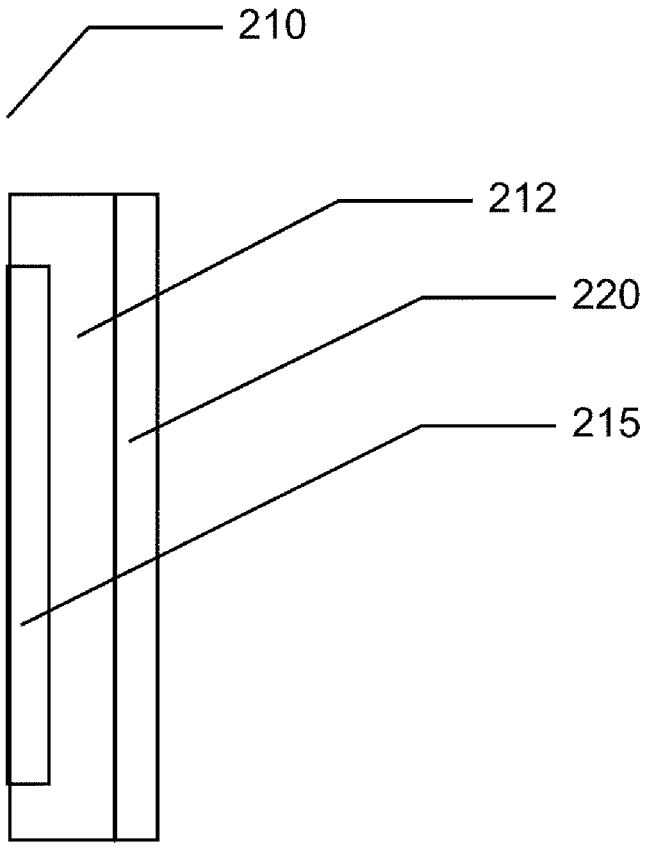
FIG. 10D is a drawing illustrating a magnet molded inside the plastic puzzle piece according to an embodiment of the present invention.

Refer to FIG. 10D is a drawing illustrating a magnet molded inside the plastic puzzle piece according to an embodiment of the present invention.

In the embodiment illustrated in FIG. 10D the plastic puzzle piece 210 comprises a plastic layer 212, a printed layer 220 disposed on the front surface of the plastic layer 212, and a magnet 215 molded into or molded inside of the plastic layer 212.

Embedding or molding the magnet 215 into the plastic layer 212 prevents the magnet 215 from being easily separated from the plastic layer 212.

Figure 11A:
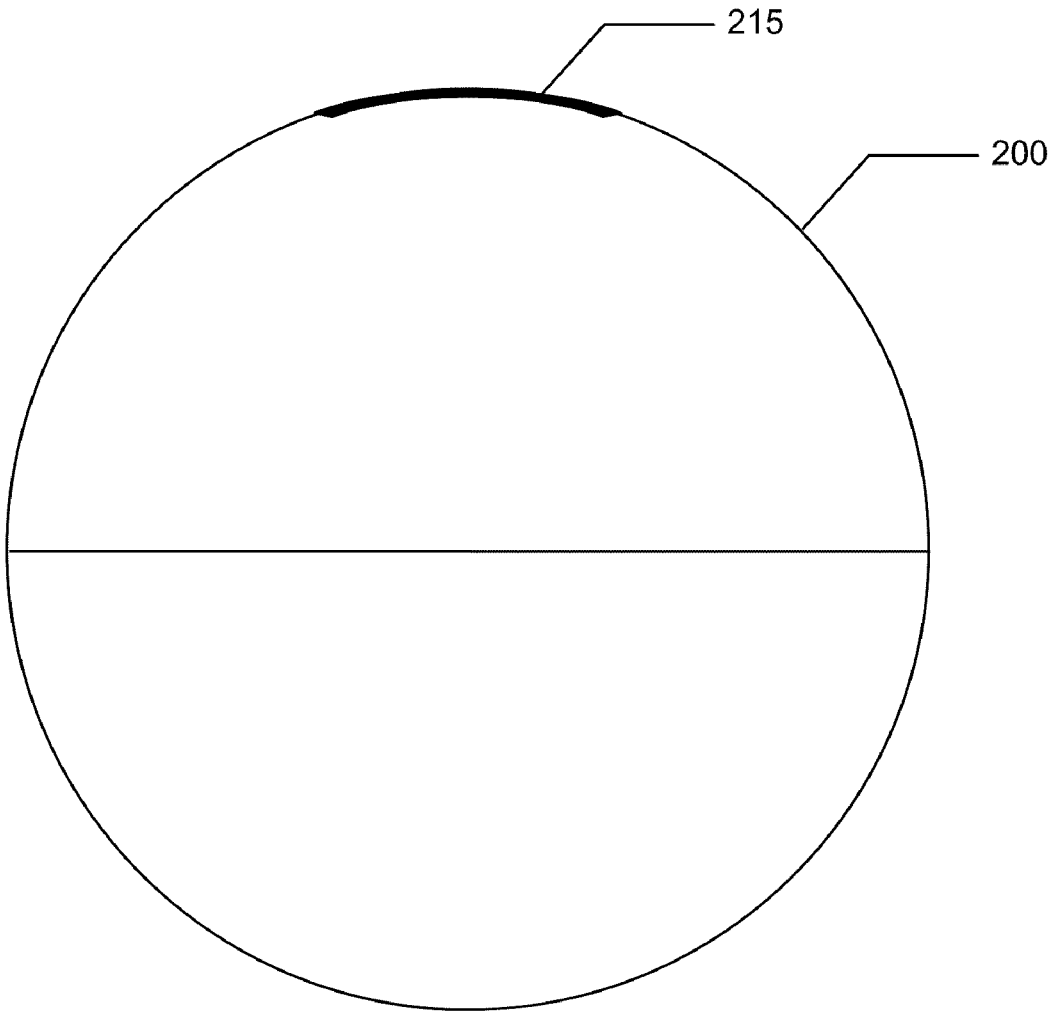
FIG. 11A is a cross-sectional drawing illustrating a plastic sphere with interior magnet according to an embodiment of the present invention.

Refer to FIG. 11A, which is a cross-sectional drawing illustrating a plastic sphere with interior magnet according to an embodiment of the present invention.

In the embodiment illustrated in FIG. 11A the plastic sphere 200 of the spherical puzzle comprises a magnet 215 or a plurality of magnets disposed inside or on the interior surface of the plastic sphere 200.

In an embodiment of the present invention the magnets are only disposed in areas where the plastic puzzle pieces are intended to be placed.

In an embodiment of the present invention the magnets are disposed on the outside or exterior surface of the plastic sphere.

Figure 11B:
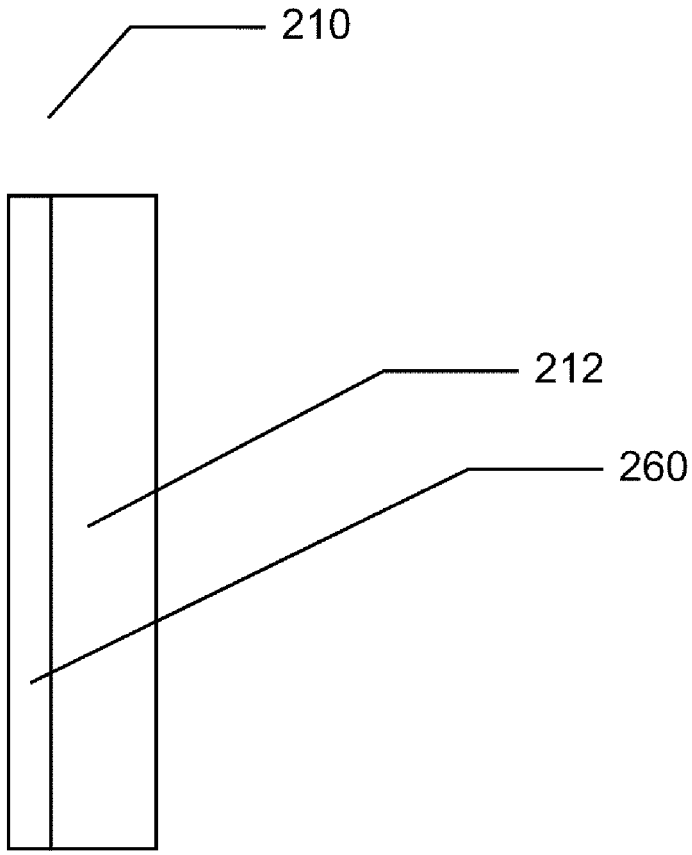
FIG. 11B is a drawing illustrating a plastic puzzle piece with metal mesh according to an embodiment of the present invention.

Refer to FIG. 11B, which is a drawing illustrating a plastic puzzle piece with metal mesh according to an embodiment of the present invention.

In embodiments of the present invention where magnets are positioned in or on the plastic sphere, the puzzle pieces 210 comprise metal mesh 260 for magnetically attachment of the plastic puzzle pieces 210 to the plastic sphere. The metal mesh 260 is disposed on the back surface of the plastic layer 212.

In an embodiment of the present invention the puzzle piece 210 further comprises a printed layer between the metal mesh 260 and the plastic layer 212.

In an embodiment of the present invention the puzzle piece 210 comprises a printed layer on the front surface of the plastic layer 212 and a metal mesh 260 on the back surface of the plastic layer 212.

Figure 12:
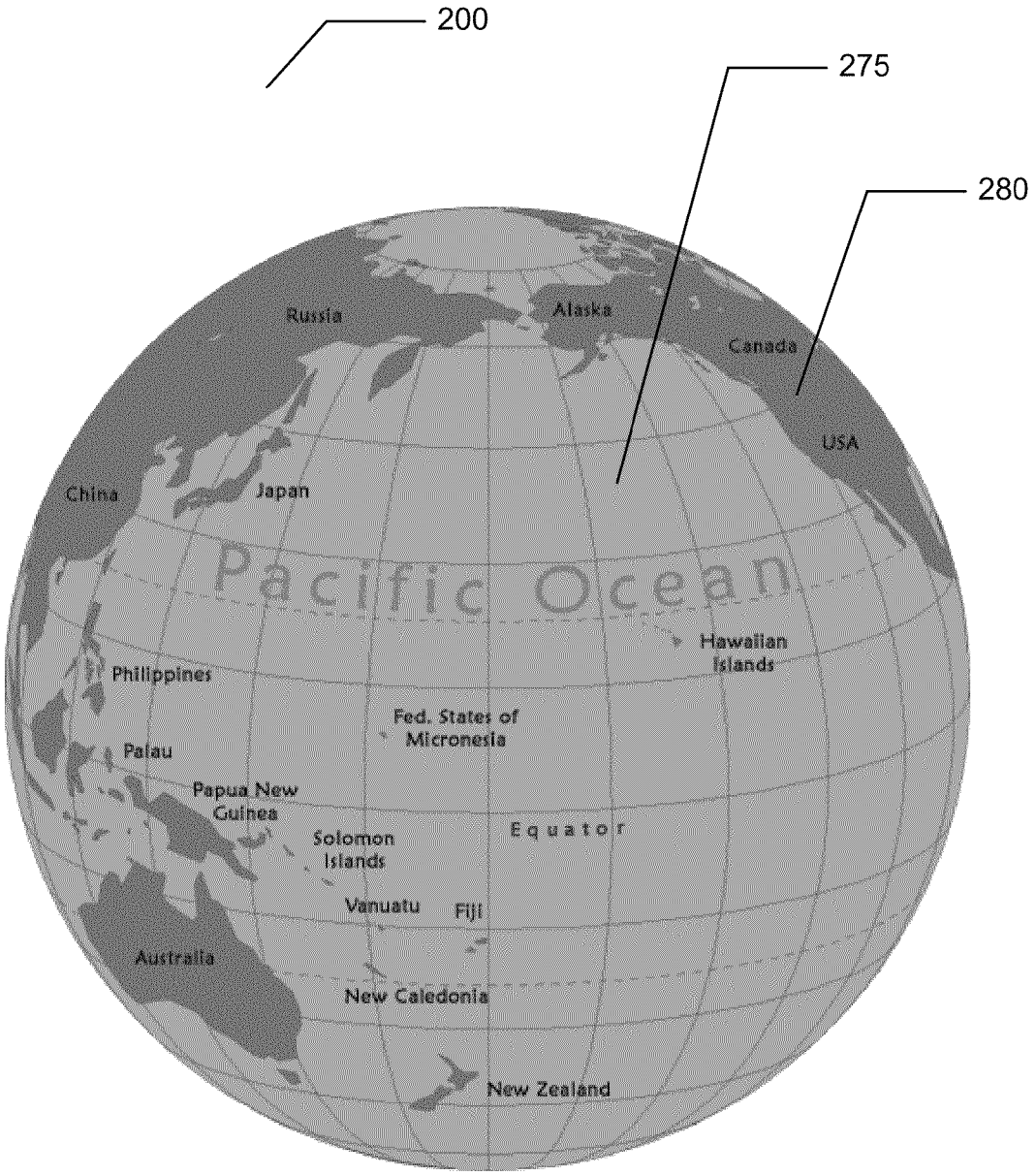
FIG. 12 is a drawing illustrating a plastic sphere with preformed water mass positions according to an embodiment of the present invention.

Refer to FIG. 12, which is a drawing illustrating a plastic sphere with preformed water mass positions according to an embodiment of the present invention.

In the embodiment illustrated in FIG. 12, areas on the plastic sphere 200 where there is a water mass such as, for example, a lake, an ocean, or a sea are formed in or on the plastic sphere 200 during production. This provides the user with a starting point in which to begin solving the spherical puzzle and also provides a reference for the user while solving the spherical puzzle.

For example, in FIG. 12 the water mass 275 indicating the Pacific Ocean is formed in the surface of the plastic sphere 200 during production. Additionally, indicators for other water masses such as the Atlantic Ocean are also formed in the plastic sphere during production. For example, water mass locations are colored, indented, protruding, or outlined so that the locations of the water masses are easily visible and fixed.

Areas of the plastic sphere indicating land masses 280 are where the appropriate puzzle pieces are to be positioned.

In an embodiment of the present invention the land masses 280 comprise indications of the respective land mass. For example, name, outline, etc. are provided to help the user.

In an embodiment of the present invention no indicators or indications are provided to indicate the position or location of the land masses 280. This makes solving the spherical puzzle more challenging.

In an embodiment of the present invention the spherical puzzle further comprises separate flag pieces representing the flags of individual countries. After the puzzle piece is positioned the user places the appropriate flag piece on/in the puzzle piece.

In an embodiment of the present invention the spherical puzzle further comprises separate informational pieces. The informational pieces allow the spherical puzzle to be personalized. The informational pieces comprise information such as, for example, sports team, advertising, company logo, etc. For example, a multinational corporation could provide informational pieces for indicating branch office locations.

The spherical puzzle of the present invention provides flexibility in learning. For example, basic puzzle pieces such as continents can be used by beginner students and more advanced puzzle pieces such as countries can be used by advanced students. Also, different students can use the same sphere with different puzzles.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A spherical puzzle comprising:

a plastic sphere; and a plurality of plastic puzzle pieces, each plastic puzzle piece magnetically attachable to the plastic sphere;

wherein the plastic sphere comprises metal mesh and each plastic puzzle piece comprises a magnetic layer.

2. The spherical puzzle of claim 1, wherein at least one plastic puzzle piece is formed in a shape of a land mass.

3. The spherical puzzle of claim 1, wherein at least one plastic puzzle piece has terrain contours.

4. The spherical puzzle of claim 1, further comprising:

a resting base for holding the plastic sphere.

5. The spherical puzzle of claim 1, further comprising:

a mounting base for holding the plastic sphere.

6. The spherical puzzle of claim 1, wherein at least one plastic puzzle piece comprises data, the data comprising country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information.

7. The spherical puzzle of claim 1, where each plastic puzzle piece comprises a transparent plastic layer, a magnetic layer, and a printed layer.

8. The spherical puzzle of claim 1, the plastic sphere comprising two plastic half-sphere pieces that attach together to form the plastic sphere.

9. The spherical puzzle of claim 1, the plastic sphere comprising longitudinal and latitudinal indicators.

10. The spherical puzzle of claim 1, the plastic sphere comprising indicators for water mass locations.

11. The spherical puzzle of claim 1, further comprising:

a plurality of country flags attachable to the plurality of plastic puzzle pieces.

12. The spherical puzzle of claim 1, the plastic sphere comprising at least one magnet positioned inside the plastic sphere.

13. A spherical puzzle comprising:

a plastic sphere comprising metal mesh; and a plurality of magnetic puzzle pieces, at least one magnetic puzzle piece formed in a shape of a land mass and the plurality of magnetic puzzle pieces magnetically attachable to the metal mesh of the plastic sphere.

14. The spherical puzzle of claim 13, wherein at least one magnetic puzzle piece comprises data, the data comprising country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information.

15. The spherical puzzle of claim 13, each magnetic puzzle piece comprising a magnetic layer, a plastic layer, and a printed layer.

16. The spherical puzzle of claim 13, the plastic sphere comprising preformed indicators for water mass locations.

17. A spherical puzzle comprising:

a first plastic half-sphere;

a second plastic half-sphere, the first plastic half-sphere and the second plastic half-sphere attachable together to form a plastic sphere; and a plurality of plastic puzzle pieces, each plastic puzzle piece magnetically attachable to the plastic sphere;

wherein the plastic sphere comprises metal mesh and the plurality of plastic puzzle pieces comprise a magnetic layer; or wherein the plastic sphere comprises a magnetic layer and the plurality of plastic puzzle pieces comprise metal mesh.

18. The spherical puzzle of claim 17, wherein at least one plastic puzzle piece comprises data, the data comprising country information, continent information, state information, province information, region information, territory information, land mass information, water mass information, mountain information, country flag, sports team information, advertising, population, logo, latitudinal information, longitudinal information, global positioning satellite information, or elevation information, or a combination of country information, continent information, state information, province information, region information, territory information, land mass information, water mass information, mountain information, country flag, sports team information, population, logo, latitudinal information, longitudinal information, global positioning satellite information, and elevation information.

* * * * *